United States Patent [19]

Newsom

[11] 4,250,480

[45] Feb. 10, 1981

[54] APPARATUS AND METHOD OF MONITORING AUTOMATIC SAFETY CONTROL SWITCHES OF ELECTRICAL APPARATUS

[75] Inventor: Charles F. Newsom, 3731 Ole Miss Dr., Kenner, La. 70062

[73] Assignee: Charles Fred Newsom, Kenner, La.

[21] Appl. No.: 6,933

[22] Filed: Jan. 25, 1979

[51] Int. Cl.[3] ..... H01H/71/04

[52] U.S. Cl. ..... 337/6; 337/14; 340/638; 340/652

[58] Field of Search ..... 337/1, 2, 337/3, 5, 14, 35, 241, 244, 407–409, 130, 155, 6; 340/590, 638, 640, 652

[56] References Cited

U.S. PATENT DOCUMENTS 2,855,483 10/1958 Swing et al. ..... 340/638

3,158,713 11/1964 Margulies ..... 340/652

4,030,061 6/1977 Gaskell et al. ..... 337/409

*Primary Examiner*—William H. Beha, Jr.

*Attorney, Agent, or Firm*—James B. Lake, Jr.

[57] ABSTRACT

A heat-triggered, mechanically-actuated apparatus comprising a heating and conducting linkage connected in parallel with an automatically resetting safety control switch across the power supply of electrical equipment, an initial opening of the control switch being indicated by the steps of heating of a heat-softenable rigid rod by the power supply passing through the heating and conducting linkage supported thereby, and breaking the linkage by a spring biasing the heat-softened rod to collapse and release a frictional connector in the linkage, and oppositely biasing an indicator, normally concealed a part of the linkage, into view.

2 Claims, 4 Drawing Figures

APPARATUS AND METHOD OF MONITORING AUTOMATIC SAFETY CONTROL SWITCHES OF ELECTRICAL APPARATUS

BACKGROUND OF THE INVENTION

The invention generally relates to monitoring or indicating the opening of an automatic safety control switch connected to protect electrical equipment from overload, and more particularly to visually indicate by mechanical means an initial opening of an automatically resetting safety control switch.

The best prior art is my U.S. Pat. No. 4,092,625 issued May 30, 1978 for a monitoring device for similar purpose that disclosed the combustion of a chemical mixture triggered by the opening of the safety control switch, which being automatic, could close with no indication that it was ever open. Cited as the closest art to my previous invention were the following U.S. patents: K. M. Kiel U.S. Pat. No. 2,712,575 for a squib switch for use with proximity fuzes of projectiles; R. C. Evans et al U.S. Pat. No. 2,790,877 for a switch actuated by a chemical change; I. Kabik U.S. Pat. No. 3,118,994 for a continuously adjustable ignition type time delay switch; and Charles R. Olsen U.S. Pat. No. 3,948,143 for an electropyrotechnic link that is activated by an electrical signal to release an object on command, such as a springler system, etc.

The invention is not a switch nor a safety device such as a fuse or a circuit breaker. It is specially designed to indicate casualty sufficient to activate the safety control switch which might have self-corrected with no indication of having been activated.

SUMMARY OF THE INVENTION

The invention is an improvement on my former invention, cited above, in that the method of operation depends on combustion which was the cause of concern to some prospective users in hot environs.

An object of the invention is to provide apparatus and method for monitoring or indicating an opening of a safety control switch by visual mechanical means after said switch has automatically reset.

DESCRIPTION OF THE PREFERRED EMBODIMENTS

Figure 1:
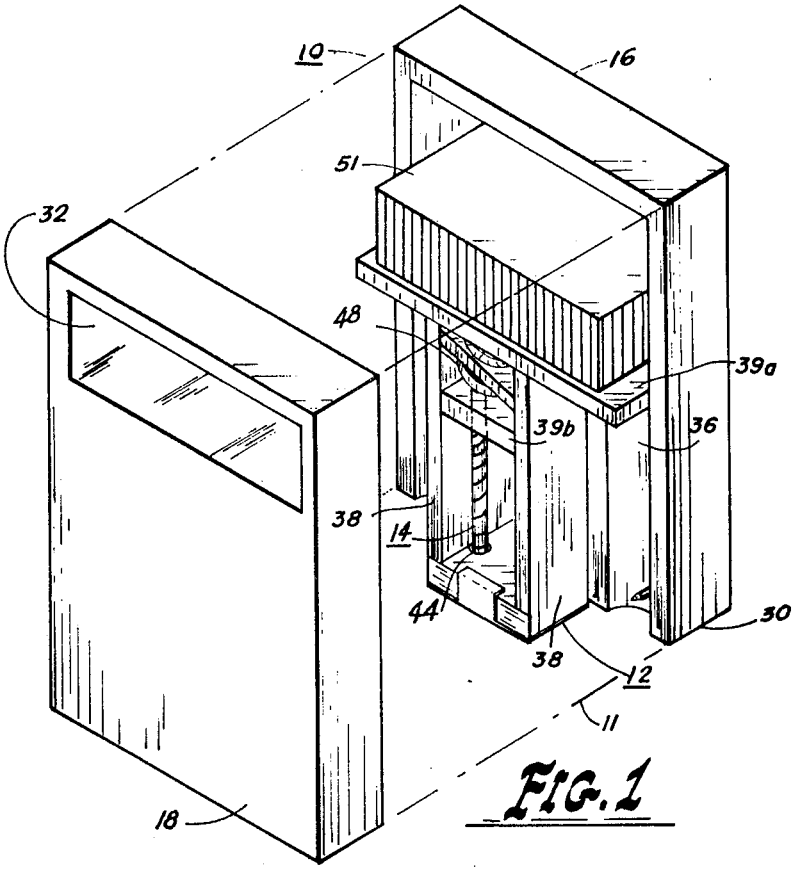
FIG. 1 is a three dimensional drawing of the invention with half of an enclosing housing removed and showing linkage position as installed.
Figure 2:
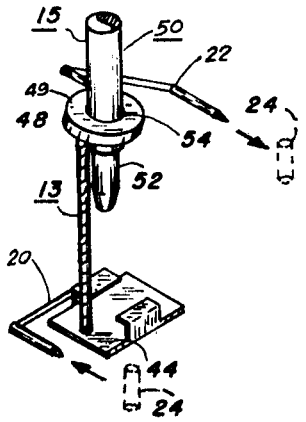
FIG. 2 is a diagram of the electrical circuit of the invention.

Referring to FIG. 1, the invention 10 comprises a non-conducting housing 11, a non-conducting frame 12 adapted to snugly fit into housing 11, and a heating and conducting linkage 14 mounted in said frame. A lower part 13 of said linkage 14 is fixed in said frame 12 and an upper part 15 slidably mounted therein.

Housing 11 comprises two similar housing halves 16 and 18, the halves differing only in the provision in the housing half 16 for mounting line connectors 20 and 22 of heating and conducting linkage 14 for penetrating the insulation of the inserted ends of external leads 24 used to operably connect the invention in parallel with an automatic safety control switch (not shown). Housing halves 16 and 18 are sealed to enclose frame 12 and linkage 14 with free ends 26 and 28 of external leads 24 extending from an end 30 of housing 10. The housing is opaque except for a clear window 32 defined adjacent an end 34 that is opposite end 30. Transversely spaced and channeled dividers 36 in housing 11 support frame 12 and engage leads 24.

Frame 12 is "T" shaped and defined by integral vertical and horizonal flat plate member 38 and 39*a* and *b*, respectively for receiving and supporting heating and conducting linkage 14.

Figure 4:
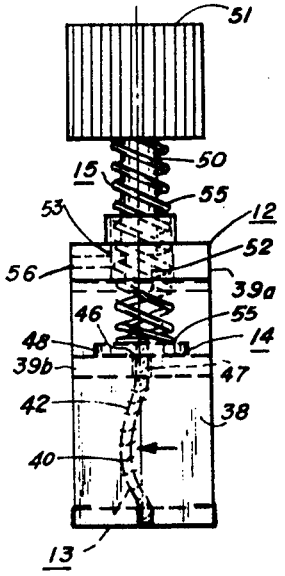
FIG. 4 is an enlarged side view of the linkage showing position of parts after actuation.

Heating and conducting linkage 14 comprises a conductor heating filament 40 wound around a non-conducting heat-softenable rigid rod or post 42 with terminals 44 and 46 at the oppositely disposed ends thereof. Rod 42 is mounted upright in frame 12 to extend thru a hole 47 in horizontal flat plate member 39*b*, and the lower terminal 44 is contacted by line connector 20. The upper terminal 46 is contacted by a conducting annulus 48, having an insulated upper surface 49, that is supported in an inclined position as shown in FIG. 1 by the upper end of rod 42. Upper part 15 of linkage 14 comprise conducting link pin 50, having a non-conducting red top 51 fixed thereto that is slidably mounted in a holes 43 and 53 in horizontal flat plate members 39*a* and 39*b* respectively, of said frame 12, and is adapted for lower end 52 to frictionally engage in center hole 54 of annulus 48 when the annulus is supported in inclined position, and to disengage therefrom when annulus is normal thereto, red top 51 being concealed from view when engaged and in view in window 32 when disengaged. A conducting spring 54 is adapted to loosely engage around link pin 50 and be compressed between the annulus 48 upper insulated surface 49 and non-conducting top 51 as shown in FIG. 4. Line connector 22 extends thru a hole 56 in horizontal flat plate member 39*a* of frame 12 to contact spring 55 which is always in conducting contact with link pin 50.

Figure 3:
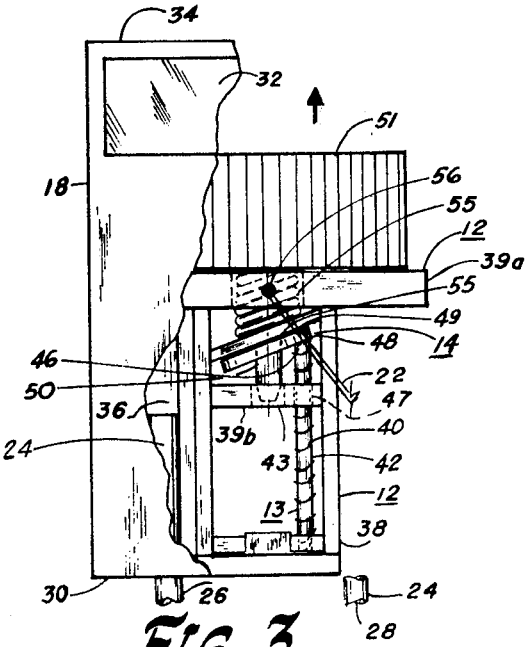
FIG. 3 is an enlarged front view of the linkage showing position of the parts before actuation.

In operation, the invention is connected in parallel with a safety control switch in the power supply line (not shown) with the lower end of link pin 50 frictionally engaged in center hole 54 of the inclined annulus as shown in FIG. 3 to complete the circuit comprising line connector 20 to lower terminal 44, to heating and resistance filament 40, to upper terminal 46, to inclined annulus 48, to pin 50, to spring 55, to line connector 22 the other side of the line. The resistance of the heating filament is sufficiently high to restrict the electrical supply current flowing therethru from generating enough heat to soften rigid post 42. Referring to FIG. 4, when the whole current is directed through the heating filament by the opening of the control switch, rod or post 42 is softened by the generated heat in the filament, and spring 55 levels annulus 48 bending post 42 downward and forcing released link pin 50 and indicator 51 upward to break the circuit thru the invention by forcing pin 50 upward out of contact with annulus 48, and with spring 55 making contact with annulus only at non-conducting upper surface 49, thus breaking circuit between upper terminal 46 with pin 50, spring 55 and line connector 22 to thereby prevent energizing the electrical equipment thru the invention as it indicates said safety control switch opening.

What is claimed is:

1. Method of monitoring the initial opening of an automatic safety control switch connected in the power supply of electrical comprising the step of:

(a) connecting a high resistance heating circuit in parallel with aid safety control switch in said electric power supply;

(b) heat triggering by the opening of said safety control switch the release of oppositely directional spring biases;

(c) breaking the high resistance circuit with one directional spring bias to prevent reenergizing said equipment through the monitor; and (d) displaying a warning indicator with the second directional spring bias.

2. Apparatus for monitoring the initial opening of an automatic safety switch connected in the power supply of electrical equipment comprising:

(a) a fixed heat softenable rod;

(b) a heating filament wound around said rod as a core and connected to an external lead by an end;

(c) a link pin, having a warning indicator, slidably mounted with respect to said rod and filament and connected to a second external lead by an end;

(d) frictional engaging means supported by said rod for the electrical connection of the free ends of said link pin and filament;

(e) spring means compressed by said electrical connection for oppositely bending said heat softened rod downward and breaking connection and biasing said link pin upward for displaying said warning indicator and breaking said connection.

* * * * *